US006309225B2

(12) United States Patent
Kameyama

(10) Patent No.: US 6,309,225 B2
(45) Date of Patent: Oct. 30, 2001

(54) CONNECTOR

(75) Inventor: Isao Kameyama, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 24 days.

(21) Appl. No.: 09/774,584

(22) Filed: Feb. 1, 2001

(30) Foreign Application Priority Data

Feb. 29, 2000 (JP) ..... 12-053870

(51) Int. Cl.[7] ..... H01R 12/00
(52) U.S. Cl. ..... 439/76.1; 439/692
(58) Field of Search ..... 439/76.1, 76.2, 439/569, 562, 550, 565, 692

(56) References Cited

U.S. PATENT DOCUMENTS

| | | | | |
|---|---|---|---|---|
| 3,989,333 | * | 11/1976 | Cauldwell | 439/76.1 |
| 4,012,094 | * | 3/1977 | VanRenssen et al. | 439/76.1 |
| 4,471,339 | * | 9/1984 | Fukada et al. | 439/76.1 |
| 4,655,518 | | 4/1987 | Johnson et al. . | |
| 5,540,596 | * | 7/1996 | Bothe et al. | 439/76.1 |
| 6,109,950 | * | 8/2000 | Trammel | 439/76.1 |

FOREIGN PATENT DOCUMENTS

| | | |
|---|---|---|
| 55-165585 | 12/1980 | (JP) . |
| 61-281485 | 12/1986 | (JP) . |
| 64-27880 | 2/1989 | (JP) . |

* cited by examiner

*Primary Examiner*—Tho D. Ta
(74) *Attorney, Agent, or Firm*—Armstrong, Westerman, Hattori, McLeland & Naughton, LLP

(57) ABSTRACT

A connector comprises a connector housing 22 which includes two terminal cover sections 26, 27 and a mounting part 28 adapted to engage with a mating member, and a plurality of terminals 23 each of which includes a connecting portion 38 and a continuously formed contact portion 39 having springy characteristics. The connecting portion 38 is projected into one of the terminal cover sections 26, and the contact portion 39 is projected into the other of the terminal cover sections 27. The other terminal cover section 27 is positioned inside the mating member after being assembled. One of the walls 32 defining the other terminal cover section 27 is provided with holes 33 through which external terminals 48 provided on the mating member are adapted to pass.

5 Claims, 4 Drawing Sheets

CONNECTOR

BACKGROUND OF THE INVENTION

1. Field of the Invention

The present invention relates to a connector which is fitted to a mating member for enabling a connection between an interior and an exterior to be made.

2. Description of the Related Art

FIG. 6 shows a CCD camera including a CCD camera body 2 contained in an outer case 1.

Structure of the CCD camera will be briefly described as below. One of side walls 3 of the outer case 1 is formed with a through hole 4, through which a connecting wire harness 5 is passed. The wire harness 5 is provided with a wire-to-wire connector 6 at a terminal end outside the outer case 1, and a wire-to-board connector 7 is provided at a terminal end at an opposite side thereof. The through hole 4 is provided with a seal member for water tight between the interior and the exterior of the outer case 1. The CCD camera body 2 is mounted on a base plate 8 and fixed at a determined position in the outer case 1 by means of screws. The base plate 8 is provided with a connector 9 of the base plate which is adapted to be connected with the wire-to-board connector 7. Reference numeral 10 represents a protective cover which is fitted to an open edge of the outer case 1.

In order to assemble the CCD camera having the above described structure, the wire harness 5 is passed through the one side wall 3 of the outer case 1 as a first step. Then, the connector 7 is connected to the connector 9 of the base plate within the outer case 1, and the base plate 8 is fixed at a determined position in the outer case 1 by means of screws. Finally, the protective cover 10 is fitted to the open edge of the outer case 1, thus finishing the assembling steps.

In the above described prior art, the wire harness 5 which is wired inside the outer case 1 had to be as short as possible according to circumstances of cost and space. For this reason, it has been difficult and annoying to manually connect the connector 7 with the connector 9 of the base plate, which results in adverse working efficiency.

The present invention has been made in view of the above circumstances, and it is an object of the invention to provide a connector in which working efficiency will be improved.

SUMMARY OF THE INVENTION

In order to solve the above described problem, there is provided a connector comprising a connector housing which includes two hood-like terminal cover sections on both sides of a partition wall provided therein, and a mounting part formed on a periphery of the connector housing to be engaged with a mating member, and a plurality of terminals each of which includes a connecting portion at its one end projected into one of the terminal cover sections which is positioned outside the mating member after being assembled, and a springy contact portion at the other end projected into the other of the terminal cover sections which is positioned inside the mating member after being assembled, the other terminal cover section of the connector housing being provided with either holes or slits on its one wall to allow external terminals provided on the mating member to pass.

According a second aspect of the invention, the contact portions of the terminals are curved toward the holes or the slits.

According to a third aspect of the invention, a pitch between the contact portions of the terminals is made larger or smaller than a pitch between the connecting portions at the other ends.

According to a fourth aspect of the invention, the mounting part of the connector housing is provided with a waterproof seal member.

According to a fifth aspect of the invention, the external terminals of the mating member are mounted on its base plate, and an outer face of the one wall is formed into a table to place the base plate thereon.

The connector according to the present invention is a connector to be fitted to the mating member. After the connector has been fitted to the mating member, the external terminals of the mating member are passed through the holes or slits formed in the other terminal cover section of the connector housing, whereby the connection between the mating member and the connector is completed.

Accordingly, wiring of the wire harness within the mating member as in the prior art is not required. Since the contact portions of the terminals have springy characteristics, they can be reliably connected with the respective external terminals which are passed through the holes or slits and brought into contact with them. Provided that the external terminals are arranged so as to pass through the holes or the slits during assembling of the mating member, the connecting work will be further simplified.

A connection outside the mating member can be conducted through the one terminal cover section.

According to the second aspect of the invention, contactability with the external terminals will be enhanced because the contact portions of the terminals are curved toward the holes or the slits formed in the other terminal cover section.

According to the third aspect of the invention, the connector can be manufactured according to the pitch of the external terminals, because the pitch between the contact portions is made larger or smaller than the pitch between the connecting portions. Provided that the pitch between the contact portions is made small, it will be possible to downsize the connector.

According to the fourth aspect of the invention, the connector can be watertightly fitted, because the mounting part is provided with the waterproof seal member.

According to the fifth aspect of the invention, because the external terminal are mounted on the base plate, and the outer face of the one wall of the terminal cover section is formed flat allowing the base plate to be placed thereon, thus the base plate can be easily fitted, and stability of the base plate can be secured.

DESCRIPTION OF THE PREFERRED EMBODIMENTS

Figure 1:
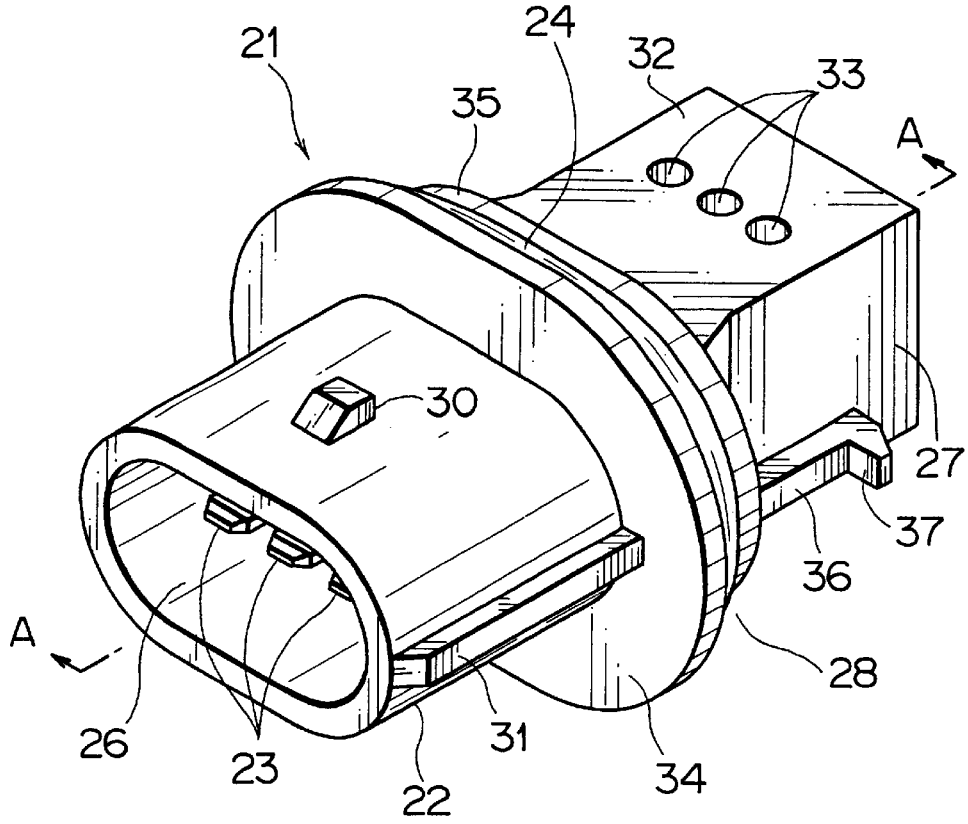
FIG. 1 is a perspective view of an outer appearance showing one embodiment of a connector according to the present invention.

Now, one embodiment of the present invention will be described referring to the drawings.

Figure 2:
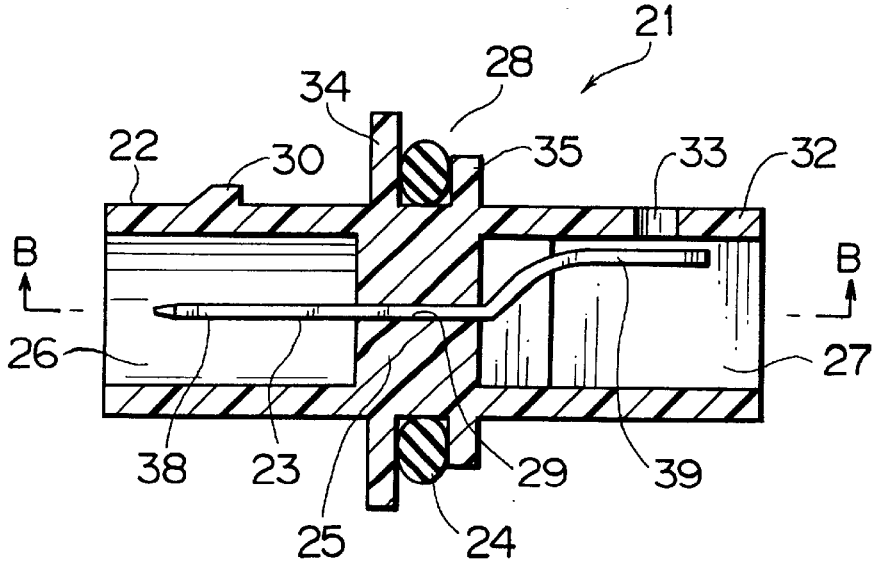
FIG. 2 is a sectional view taken along a line A—A of FIG. 1.
Figure 3:
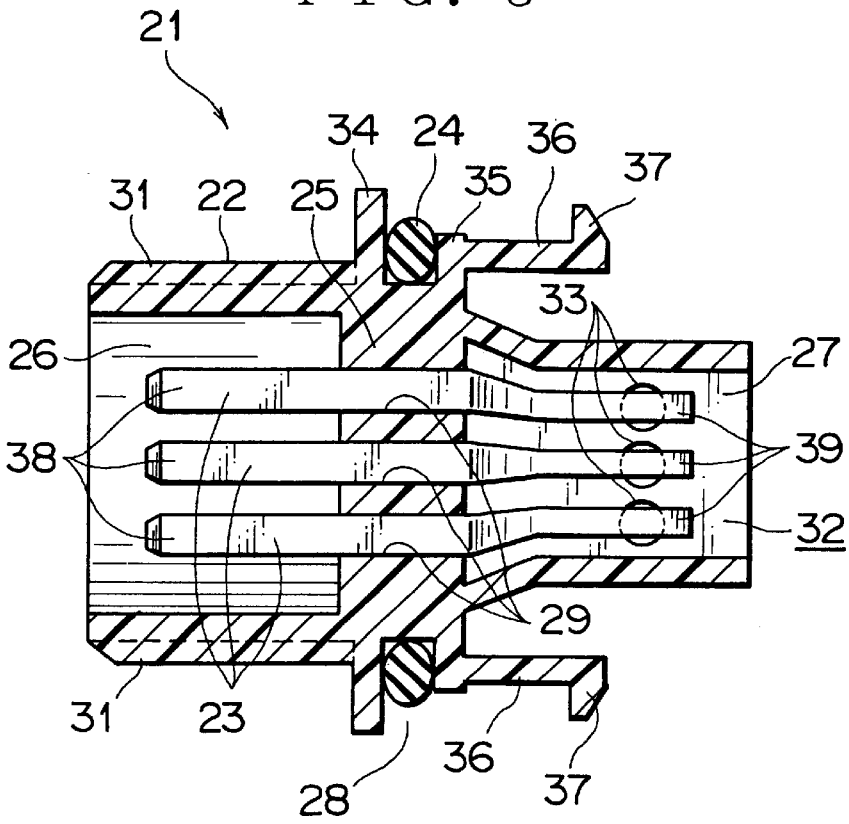
FIG. 3 is a sectional view taken along a line B—B of FIG. 2.

In FIGS. 1 to 3, a connector 21 is composed of a connector housing 22 made of synthetic resin, and a plurality of terminals 23 mounted in the connector housing 22. The connector 21 is constructed as a relay connector.

Although there are three terminals provided in this embodiment, the number is not limited to three. Moreover, the connector housing 22 is provided with a known O-ring 24 or a packing. The connector may be designed as a waterproof connector.

The above described connector housing 22 is provided with a partition 25 at a substantially center part thereof. At both forward and backward sides of the partition wall 25, are respectively formed terminal cover sections 26 and 27. At an intermediate part outside the connector housing 22, is integrally formed a mounting part 28 to which the 0-ring 24 can be fitted afterward.

The partition wall 25 is formed having a larger thickness than other parts in order to retain the aforesaid terminals 23. Moreover, the partition wall 25 is provided with three terminal insertion holes 29 corresponding to the aforesaid terminals 23 at an equal pitch (This is not applied to a case in which the terminals 23 have been insert molded).

The forward terminal cover section 26 is formed in a hood-like shape having a substantially oval outer shape in cross section. The terminal cover section 26 is provided with an engaging projection 30 and a pair of guide ribs 31, 31. The engaging projection 30 projects from an intermediate portion of a wall defining the terminal cover section 26, and the guide ribs 31, 31 are formed on both sides of the terminal cover section 26 in an axial direction (in a back and forth direction) of the connector housing 22.

The backward terminal cover section 27 is rather smaller than the forward terminal cover section 26 and formed in a hood-like shape having a substantially rectangular outer shape in cross section. One of the walls 32 defining the backward terminal cover section 27 is provided with three through holes 33. The holes 33 are formed in alignment with positions of the terminals 23. The one wall 32 is formed in a flat face. This wall 32 corresponds to "one wall" described in the claims.

Although a shape of the hole 33 is round in this embodiment, it may be rectangular, for example, provided that the below mentioned external terminal 48 (See FIG. 4) can be smoothly guided. Further, slits may be formed in place of the holes 33.

It is so constructed that opposite ends of the terminals 23 will not project from open edges of the terminal cover sections 26 and 27.

The mounting part 28 is composed of flanges 34, 35 between which the O-ring 24 can be fitted afterward, and a pair of lock arms 36, 36 which are adapted to be engaged with a mating member. The flange 34 is circumferentially provided around the connector housing 22 so as to project in a substantially oval shape correspondingly to the outer shape of the terminal cover section 26. The flange 35 has a rather smaller projecting amount than the flange 34. The flanges 34 and 35 are designed to have such thickness that deformation will not occur when the O-ring 24 is fitted later.

The lock arms 36, 36 have flexibility, and at the same time, are formed so as to continue from the flange 35 along the axial direction of the connector housing 22. Distal ends of the lock arms 36, 36 are positioned at a midway of the terminal cover section 27. The lock arms 36, 36 are formed at such positions where a connection with the below mentioned external terminal 48 (see FIG. 4) will not be disturbed. Distal ends of the lock arms 36, 36 are provided with hook-like locking projections 37, 37 projecting outward. The locking projections 37, 37 have tapered areas and are appropriately formed according to a shape of the mating member.

The terminal 23 is manufactured by stamping a metal plate having electric conductivity and composed of a tab-like connecting portion 38 and a contact portion 39 continuously formed from the connecting portion 38. In other words, one end of the terminal 23 is designed as the connecting portion 38 and the other end is designed as the contact portion 39.

The connecting portion 38 is passed through the terminal insertion hole 29 and its distal end is guided into the terminal cover section 26. The contact portion 39 is guided into the terminal cover section 27. The contact portion 39 has elasticity and is curved so that its distal end may be drawn near the hole 33 in order to improve contactability with respect to the below mentioned external terminal 48 (See FIG. 4).

In this embodiment, a pitch between the contact portions 39 is narrower than a pitch between the connecting portions 38. Of course, the pitch between the contact portions 39 can be increased. In case of the narrower pitch, the connector can be downsized. The pitch between the contact portions 39 corresponds to a pitch between the below mentioned external terminals 48 (See FIG. 4). The terminal 23 is further provided with a pair of locking projections (not shown) adapted to be engaged with the partition wall 25.

In the above described structure, the terminals 23 are mounted in the connector housing 22 in such a manner that the contact portions 39 may be drawn near the holes 33 of the terminal cover section 27, thereby to assemble the connector 21. The connector 21 is mounted on a CCD camera, for example.

Now, a structure of the CCD camera will be briefly described.

Figure 4:
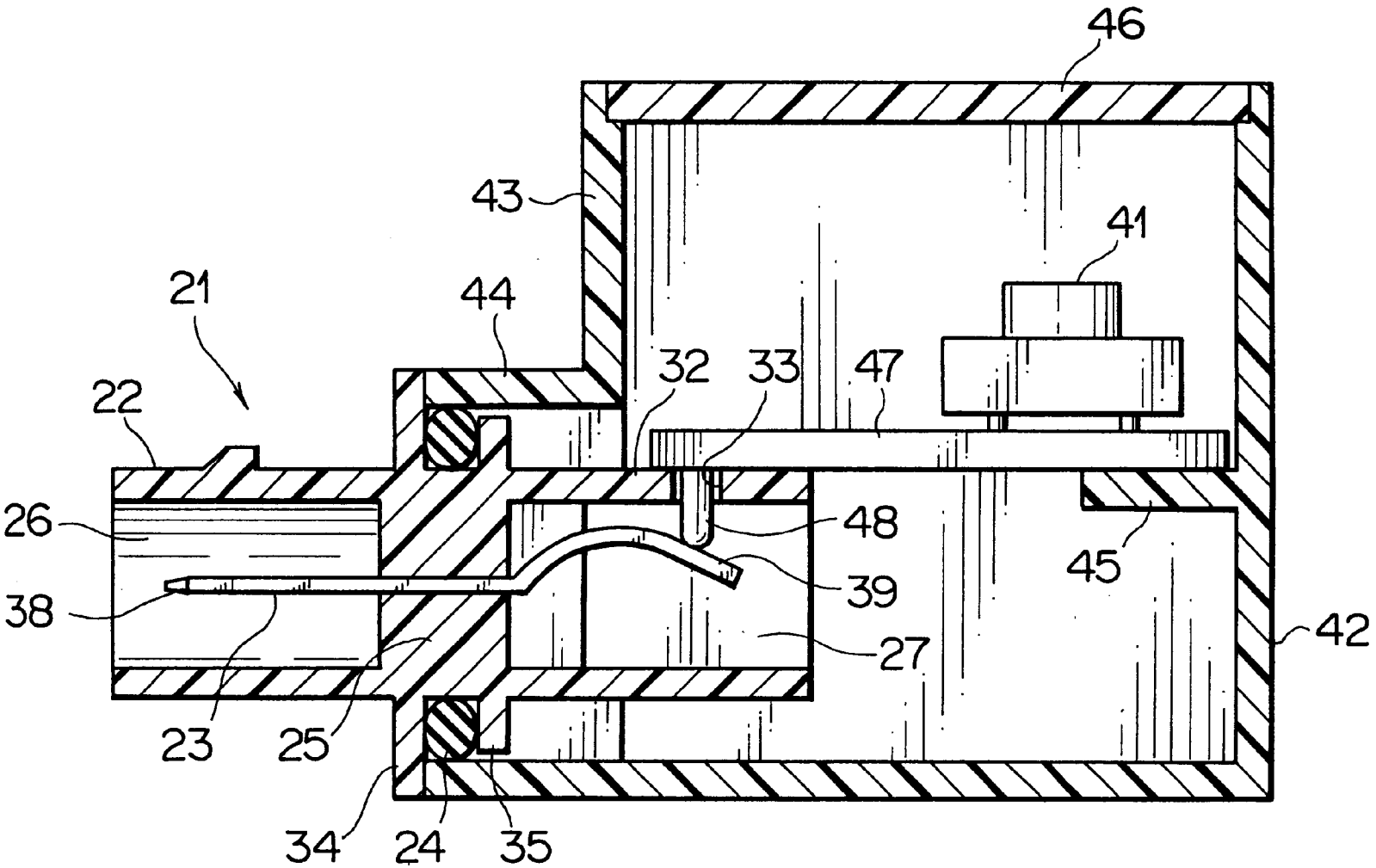
FIG. 4 is a sectional view of a CCD camera (a mating member) which is engaged with the connector according to the present invention.

In FIG. 4, the CCD camera includes an outer case 42 in which a CCD camera body 41 is contained. The outer case 42 is formed in a shape of a bottomed box having an open top, and has an engaging portion 44 to be engaged with the connector 21 at one of its side walls. A plurality of fitting flanges 45 are provided at appropriate positions inside the outer case 42 (Only one is shown in the drawing). A protective cover 46 is mounted over the open top and fixed by appropriate means.

Figure 5:
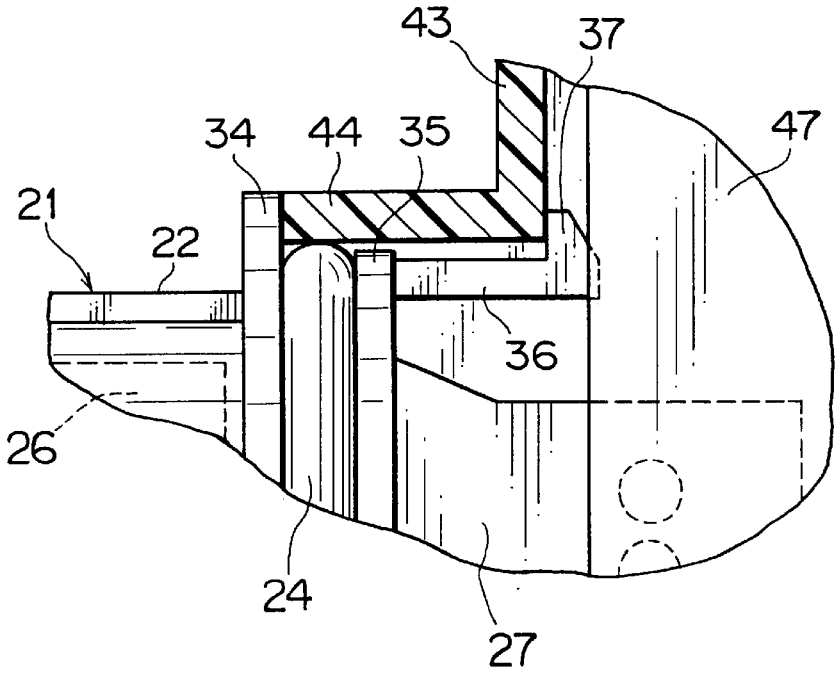
FIG. 5 is an enlarged view of an essential part of the CCD camera for explaining the engaged state.

The engaging portion 44 is formed in a frame-like shape projected from the one side wall 43 and has an opening into which the connector 21 can be inserted and fixed. A length of projection of the engaging portion 44 is so set as to be substantially equal to a length between the flange 34 of the connector 21 and the locking projection 37 of the lock arm 36 (see FIG. 5).

The CCD camera body 41 is mounted on a base plate 47. A plurality of (three in this embodiment) external terminals 48 electrically continued to the CCD camera are arranged underneath the base plate 47 so as to project therefrom at a right angle. Outer edge portions of the base plate 47 are placed on the flange 45 and fixed by means of a plurality of screws (not shown). Each of the external terminals 48 is in a shape of a round pin, for example, and has such a length that it can sufficiently press the contact portion 39 when the connector 21 is inserted.

Then, assembling of the CCD camera will be described.

In order to assemble the CCD camera, the connector 21 is engaged with the engaging portion 44 of the outer case 42 as a first step. On this occasion, the terminal cover section 27 of the connector 21 is inserted into the outer case 42 through the engaging portion 44. During the insertion, the locking projection 37, 37 of the lock arms 36, 36 are abutted against an open edge of the engaging portion 44, but the lock arms 36, 36 are flexed inwardly allowing the connector 21 to be inserted. When the flange 34 of the connector 21 has contacted the open edge of the engaging portion 44, insertion of the connector 21 is restrained, and at the same time, the locking projection 37, 37 of the lock arms 36, 36 are brought into engagement with an inner wall of the outer case 42 (See FIG. 5). The O-ring 24 is compressed by the engaging portion 44. Thus, the connector has been watertightly fitted to the outer case 42.

Then, the base plate 47 equipped with the CCD camera body 41 is fixed in the outer case 42. The external terminals 48 have been already set at determined positions on the base plate 47. The base plate 47 is placed on the flange 45 and aligned for screw fitting. On this occasion, the external terminals 48 are introduced into the terminal cover section 27 through the holes 33 and brought into contact with the contact portions 39. The contact portions 39 are pressed by the external terminal 48 and slightly deformed elastically. An area of the base plate 47 which is provided with the external terminals 48 is placed on the flat wall 32 of the terminal cover section 27. Thus, the base plate 47 has been disposed in a stable manner. Then, the base plate 47 is fastened by the screws to be fixed inside the outer case 42, and at the same time, connections between the external terminals 48 and the terminals 23 have been completed. The connections will be perfect in a state where the contact portions 39 are pressed by the external terminals 48.

Finally, the protective cover 46 is mounted over the open top of the outer case 42 and fixed by the appropriate means. A series of the assembling works have been finished in this manner.

It is to be noted that a wire harness (not shown) is connected to the other terminal cover section 26 of the connector 21.

As described above referring to FIGS. 1 to 5, by passing the external terminals 48 through the holes 33 of the terminal cover section 27 after the connector 21 is engaged with the mating member (the CCD camera in the described embodiment), the connection inside the mating member can be easily conducted. Moreover, the connector 21 can be easily fitted by way of the mounting part 28.

Figure 6:
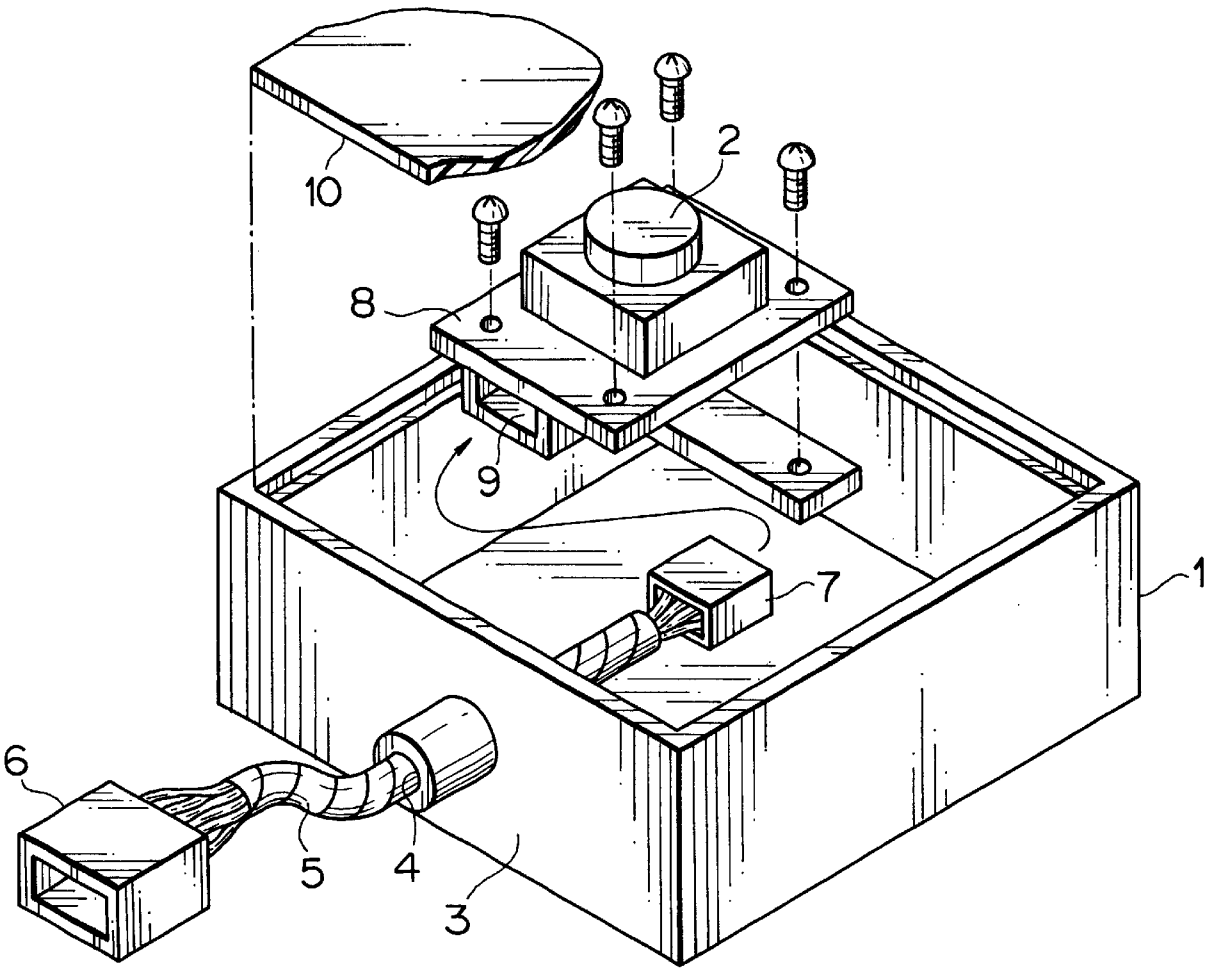
FIG. 6 PRIOR ART
FIG. 6 is an exploded perspective view of a conventional CCD camera.

Accordingly, the connection between the connectors, for example between the connector 7 and the connector 9 of the base plate in FIG. 6 as in the prior art will not be required. The wiring work of the wire harness 5 as shown in FIG. 6 will not be required too. Needless to say, this will improve the working efficiency.

It is apparent that various changes and modifications can be added to the present invention within a scope of the invention.

For example, since the above described connector 21 is the relay connector, it can be fitted not only to the CCD camera but to a junction box which is mounted on a vehicle or the like. Further, it is also possible to provide a structure without the O-ring 24 (For example, the O-ring 24 and the flange 35 may be omitted from the structure).

What is claimed is:

1. A connector comprising a connector housing which includes two hood-like terminal cover sections on both sides of a partition wall provided therein, and a mounting part formed on a periphery of said connector housing to be engaged with a mating member, and a plurality of terminals each of which includes a connecting portion at its one end projected into one of said terminal cover sections which is positioned outside said mating member after being assembled, and a springy contact portion at the other end projected into the other of said terminal cover sections which is positioned inside said mating member after being assembled, said other terminal cover section of said connector housing being provided with either holes or slits on its one wall to allow external terminals provided on said mating member to pass.

2. The connector according to claim 1, wherein said contact portions of said terminals are curved toward said holes or said slits.

3. The connector according to claim 1, wherein a pitch between said contact portions is made larger or smaller than a pitch between said connecting portions at the other ends.

4. The connector according to claims 1, wherein said mounting part of said connector housing is provided with a waterproof seal member.

5. The connector according to any one of claims 1 to 4, wherein said external terminals of said mating member are mounted on its base plate, and an outer face of said one wall is formed into a table to place said base plate thereon.

* * * * *

UNITED STATES PATENT AND TRADEMARK OFFICE

CERTIFICATE OF CORRECTION

PATENT NO. : 6,309,225 B1
DATED : October 30, 2001
INVENTOR(S) : Isao Kameyama

It is certified that error appears in the above-identified patent and that said Letters Patent is hereby corrected as shown below:

Title page,
Amend the title page as follows:
Item [30]: Change "Feb. 29, 2000 (JP).....12-053870" to
-- Feb. 29, 2000 (JP).....2000-53870 --.

Signed and Sealed this

Thirtieth Day of April, 2002

*Attest:*

*Attesting Officer*

JAMES E. ROGAN
*Director of the United States Patent and Trademark Office*